US012485360B2

(12) United States Patent
Donahue

(10) Patent No.: US 12,485,360 B2
(45) Date of Patent: Dec. 2, 2025

(54) INTERLOCKING BUILDING BLOCK SYSTEM

(71) Applicant: Brick x Brick LLC, Rancho Palos Verdes, CA (US)

(72) Inventor: Lawrence J Donahue, Rancho Palos Verdes, CA (US)

(73) Assignee: Brick x Brick LLC, Rancho Palos Verdes, CA (US)

( * ) Notice: Subject to any disclaimer, the term of this patent is extended or adjusted under 35 U.S.C. 154(b) by 316 days.

(21) Appl. No.: 18/319,141

(22) Filed: May 17, 2023

(65) Prior Publication Data

US 2024/0382863 A1 Nov. 21, 2024

(51) Int. Cl.
*A63H 33/10* (2006.01)

(52) U.S. Cl.
CPC ..... *A63H 33/105* (2013.01)

(58) Field of Classification Search
CPC ..... A63H 33/04; A63H 33/105; F16B 1/00; F16B 17/00
See application file for complete search history.

(56) References Cited

U.S. PATENT DOCUMENTS 299,381 A * 5/1884 Grove ..... F16B 5/0052 403/294
637,024 A * 11/1899 Penwell ..... B23D 65/00 403/294
3,650,553 A * 3/1972 Wennstrom ..... E02D 5/523 403/294
6,059,631 A * 5/2000 Maddock ..... A63H 33/12 446/127
8,671,640 B1 * 3/2014 Thomas ..... E04B 2/18 52/607
9,808,733 B2 11/2017 Lambert
10,086,304 B1 * 10/2018 LaChance, III ..... A63H 33/044
(Continued)

FOREIGN PATENT DOCUMENTS

CN 217794518 U 11/2022
CN 218011052 U 12/2022
(Continued)

OTHER PUBLICATIONS

Connector, Hoffmann dovetail key, Brand: Hafele, Pub Date Feb. 22, 2023.

*Primary Examiner* — John A Ricci
(74) *Attorney, Agent, or Firm* — Briggs Intellectual Property Law; Jeremy A. Briggs

(57) ABSTRACT

An interlocking building block system is disclosed. The system may include a first building block, a second building block and an elongated connector. The first building block and the second building block may include a first recess and a second recess, respectively. The elongated connector may be configured to connect the first building block and the second building block. The elongated connector may include a first portion and a second portion connected to each other. The first portion may be configured to be inserted in the first recess and the second portion may be configured to be inserted in the second recess. Each of the first portion and the second portion may include an elongated wall and side walls. The elongated wall may include an elongated ridge at an elongated wall center portion disposed along an elongated wall length.

20 Claims, 9 Drawing Sheets

(56) References Cited

U.S. PATENT DOCUMENTS

| | | | | |
|---|---|---|---|---|
| 11,110,340 | B1 * | 9/2021 | Emricson | A63F 3/00261 |
| 2015/0259910 | A1 * | 9/2015 | Montiel Reyes | E04B 2/18 52/604 |

FOREIGN PATENT DOCUMENTS

| | | | |
|---|---|---|---|
| CN | 218011053 | | 12/2022 |
| DE | 19845160 | B4 | 4/2004 |
| JP | 3114852 | U | 10/2005 |
| KR | 200485228 | Y1 | 1/2018 |

* cited by examiner

INTERLOCKING BUILDING BLOCK SYSTEM

TECHNICAL FIELD

The present disclosure relates to an interlocking building block system, and more specifically to an interlocking building block system that facilitates convenient assembly and disassembly of building blocks using dovetail recesses and connectors.

BACKGROUND

Children typically play with building blocks to build creative structures and models. Building blocks are known to develop engineering mindset and creativity in children when the children are developing their motor skills. Adults, especially engineers, also use building blocks to build miniature models of engineering projects on which the adults may be working.

Conventional building block systems include building blocks of small sizes that may be difficult to assemble or dissemble. For example, children or adults may face inconvenience in building a structure when they may be required to assemble a substantial count of small-sized building blocks. Further, it may be challenging to build a large structure, for example, a beam or a large-sized arch, using small-sized conventional building blocks.

Thus, there is a need for a building block system that may facilitate a user in conveniently building large-sized structures.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
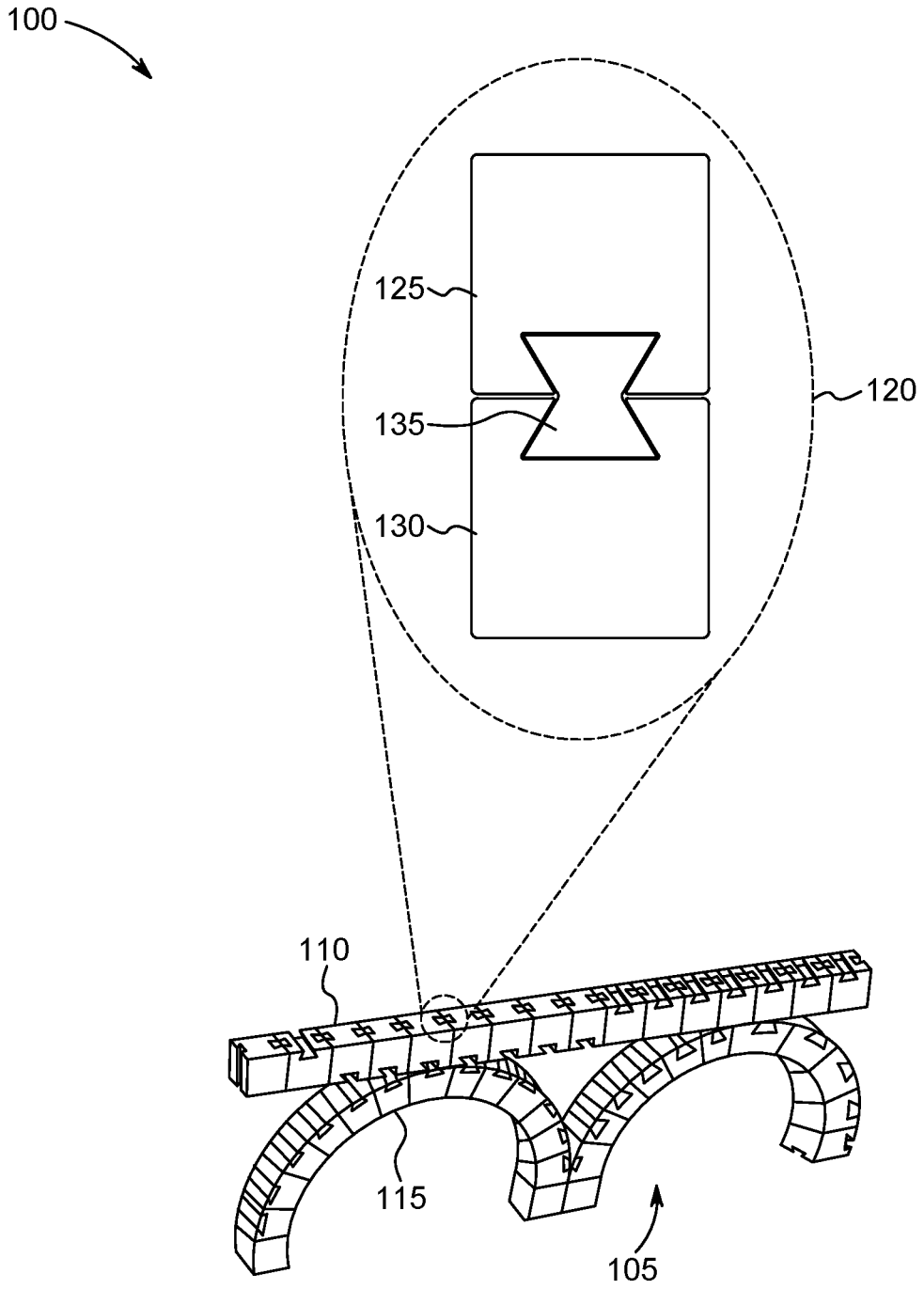
FIG. 1 depicts an example environment in which techniques and structures for providing the systems and methods disclosed herein may be implemented.

The present disclosure is directed towards an interlocking building block system that may enable a user to build different types of model structures. Examples of model structures include, but are not limited to, beams, arches, tunnels, model skyscrapers, pyramids, curves, and/or the like. The system may include a plurality of components that may be configured to removably attach with each other to enable the user build the model structures. In some aspects, the system may include a plurality of building blocks and a plurality of elongated connectors that may enable connection between the building blocks. Specifically, each building block may include a plurality of faces, and one or more faces may include dovetail recesses. A dovetail recess may be disposed at a face center portion and may have a length equivalent to a face length. The user may connect two building blocks (e.g., a first building block and a second building block) by placing the building blocks in proximity to each other such that respective recesses may be adjacent to each other, and inserting the elongated connector through the adjacent recesses.

The elongated connector may be of different shapes and dimensions to enable the user to securely connect the first building block and the second building block. For example, in one exemplary aspect, the elongated connector may include a first portion and a second portion that may be connected to each other and may have mirrored shapes. The first portion and the second portion may be dovetail shaped so that the user may easily insert the elongated connector into dovetail recesses of adjacent building blocks to enable connection between the building blocks.

In some aspects, each of the first portion and the second portion may include an elongated wall and a pair of side walls that may be slanted at a predefined angle relative to the elongated wall (or an elongated connector lateral axis). The elongated wall may be "peaked" at an elongated center portion. Specifically, the elongated wall may include an elongated ridge that may be disposed at the elongated center portion and may have a length equivalent to an elongated wall length. When the user inserts the elongated connector into adjacent recesses, the elongated ridge may touch recess surface (e.g., a recess elongated wall), and remaining elongated wall surface or portions may not touch the recess surface. Since only the elongated ridge or the "peak" touches the recess elongated wall, friction between moving parts (e.g., the elongated wall and the recess elongated wall) may be significantly reduced when the user inserts (or removes) the elongated connector into (or from) the recesses. The elongated ridge may also enable robust and secure connection between adjacent building blocks.

In other aspects, the elongated connector may have a tapered width. Specifically, each of the first portion and the second portion may include a proximal end and a distal end, and a proximal end width may be greater than a distal end width. In this case, the dovetail recesses too may have tapered widths. The user may insert the elongated connector into the adjacent recesses via the distal end. Elongated connector tapered width may ensure that the elongated connector does not "slide out" from the recesses when the elongated connector may be inserted into the recesses. The tapered width may also enable the user to build strong and sturdy model structures, for example, for engineering models.

In yet another aspect, the elongated wall may have a curved shape along an elongated wall length (e.g., shaped as a "banana"). When the user inserts the elongated connector into the adjacent recesses, the curve-shaped elongated wall may "lock" against recess side walls, thus enabling secure connection between adjacent building blocks.

In further aspects, the interlocking building block system may include additional components, e.g., cubic blocks, filler blocks, etc., which may enable the user to build the model structures. In additional aspects, the building blocks may be of different shapes and dimensions. For example, the building blocks may have a shape of a cube or a cuboid that may enable the user to build linear model structures or beams. As another example, the building blocks may have a shape of a triangle or a truncated pyramid that may enable the user to build curves or arches.

The present disclosure discloses an interlocking building block system that enables the user to build large model structures. The system includes large-sized building blocks that may be securely connected or "interlocked" with each other by using elongated connectors. The elongated connectors enable the user to stably connect large-sized building blocks, which may not be possible using conventional building blocks systems that may use small-sized building blocks and may not use connectors to interlock the building blocks. Further, the elongated connector including the elongated ridge, tapered width, and/or curved elongated wall may enable secure and robust connection between adjacent building blocks, thus assisting the user in building large-sized model structures.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example environment 100 in which techniques and structures for providing the systems and methods disclosed herein may be implemented. While describing FIG. 1, references may be made to FIGS. 2 and 3. The environment 100 may include an interlocking building block system 105 that may include a plurality of components including, but not limited to, building blocks, connectors, filler blocks, cubic blocks, and/or the like. Each component may be made of plastic, wood, metal, a combination thereof, and/or any other similar material.

A user (not shown) may build different structures or models, e.g., beams, arches, walls, tunnels, blanket forts, curves, skyscrapers, pyramids, book shelves, etc. by connecting one or more building block system components. Specifically, the plurality of components may configured to removably connect with each other and/or placed over each other to form a plurality of different structures. For example, the user may connect or assemble one or more components to build a beam 110 or an arch 115 (or any other similar structure), as shown in FIG. 1.

In some aspects, the user may build the beam 110 or a linear structure by connecting one or more building blocks that may be shaped as cube or cuboid. An exemplary view 120 of FIG. 1 depicts a first building block 125 and a second building block 130 removably connected with each other to form a linear structure. The first building block 125 and the second building block 130 may be connected with each other via an elongated connector 135. Specifically, the user may insert or slide the elongated connector 135 between recesses formed on one or more faces of the first building block 125 and the second building block 130 to enable connection between the first building block 125 and the second building block 130. Structural details of the first and second building blocks 125, 130 and the elongated connector 135 may be understood in conjunction with FIGS. 2 and 3.

Figure 2:
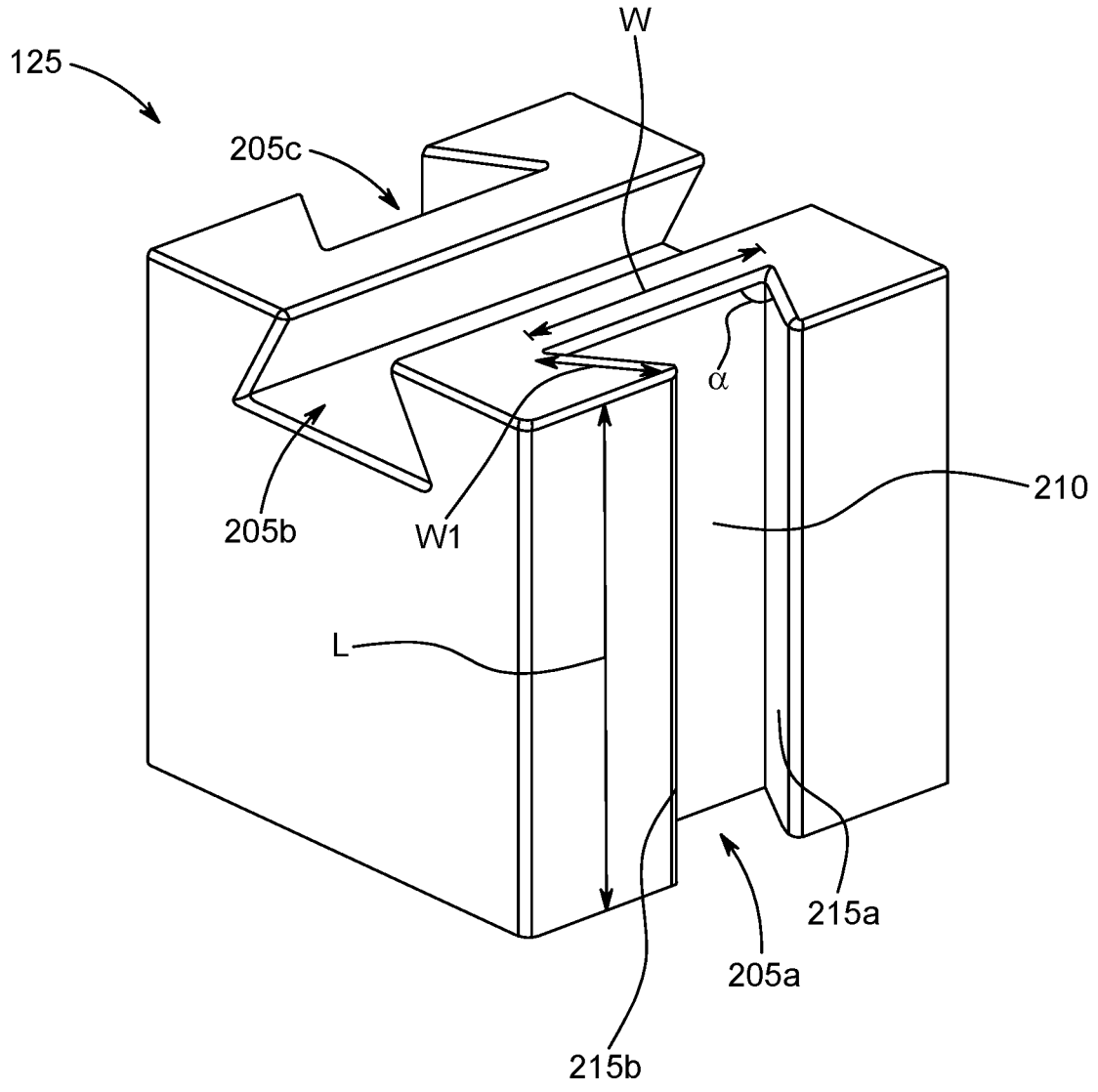
FIG. 2 depicts an isometric view of an example building block in accordance with the present disclosure.

FIG. 2 depicts an isometric view of the first building block 125 (or the second building block 130) in accordance with the present disclosure. In an exemplary aspect, the first building block 125 may be shaped as a cube having six building block faces. The first building block 125 may be a solid cube with a large-sized dimension (e.g., length) of each face in a range of 0.5 to 4 inches. A person ordinarily skilled in the art may appreciate that the first building block 125 has dimensions greater than a conventional building block. The first building block 125 may be made of wood, plastic, rubber or metal. Further, the first building block 125 may manufactured using 3D printing or known molding techniques (e.g., injection molding).

In some aspects, one or more building block faces of the first building block 125 may include recesses 205*a*, 205*b*, 205*c* (collective referred to as recess 205). In an exemplary aspect, three building block faces may include the recesses 205, and the remaining building block faces may not include recesses, as shown in FIG. 2. In other aspects, more or less than three building block faces may include the recesses 205. Further, the recess 205 may be disposed at a face center portion and may have a recess length equivalent to a building block face length. For example, if a building block face length "L" is 2 inches, the recess length too may be 2 inches. In other aspects (not shown), the recess length may be shorter than the building block face length "L". Furthermore, a recess width "W" may be substantially smaller than the building block face length "L". For example, the recess width "W" may be in a range of 30 to 60% of building block face length "L". In additional aspects (not shown), the recess 205 may not be disposed at the face center portion, and may be disposed in proximity to a building block face right or a left edge.

In some aspects, the recess 205 may be a dovetail recess having a recess elongated wall 210 and recess side walls 215*a*, 215*b* (collectively referred to as recess side walls 215). The recess side walls 215 may be slanted relative to a recess elongated wall lateral axis. Specifically, the recess side walls 215 may be disposed at a predefined angle "α" relative to the recess elongated wall lateral axis, as shown in FIG. 2. The angle "α" may range from 30 to 60 degrees. Further, a recess side wall width "W1" may be in a range of 20 to 70% of recess width "W".

In an exemplary aspect, one or more walls of the recess elongated wall 210 and the recess side walls 215 may be polished to have a smooth surface having Root Mean Square (RMS) surface finish in a range of 15 to 40 RMS. In other aspects, one or more walls of the recess elongated wall 210 and the recess side walls 215 may have a textured surface.

The user may removably connect (or assemble) the first building block 125 and the second building block 130 with each other by placing respective recesses of the first building block 125 and the second building block 130 adjacent to each other, and inserting or sliding the elongated connector 135 through the adjacent recesses. An isometric view of the elongated connector 135 is shown in FIG. 3.

The elongated connector 135 may be shaped as double dovetail (or may be shaped as a "bow tie") and may be made of similar or different material as the first and second building blocks 125, 130. The elongated connector 135 too may be manufactured using 3D printing or known molding techniques (e.g., injection molding). The elongated connector 135 may include a solid body having a first portion 305 and a second portion 310, as shown in FIG. 3. The first portion 305 and the second portion 310 may be connected with each other and may form a unified integrated structure of the elongated connector 135. Further, the first portion 305 and the second portion 310 may have mirrored shapes, and each of the first and second portions 305, 310 may have shapes complementary to the recess 205 shapes. For example, the first and second portions 305, 310 may be shaped as dovetail, which may be similar to the dovetail-shaped recesses 205.

Each of the first portion 305 and the second portion 310 may include an elongated wall 315 and side walls 320*a*, 320*b* (collectively referred to as side walls 320). Each side wall 320 may be slanted at a predefined angle "B" relative to an elongated connector lateral axis, as shown in FIG. 3. The angle "β" may be equivalent to the angle "α".

Figure 3:
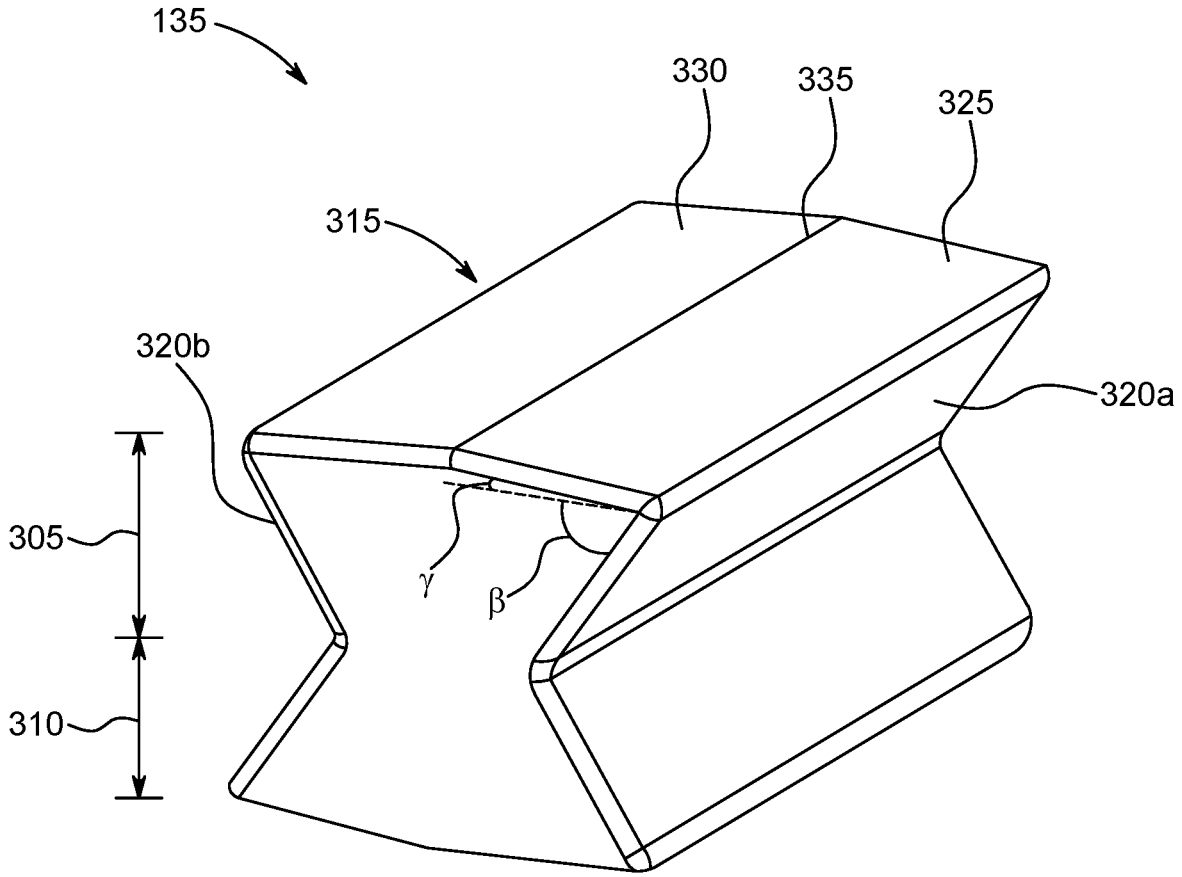
FIG. 3 depicts an isometric view of an example elongated connector in accordance with the present disclosure.

In an exemplary aspect shown in FIG. 3, the elongated wall 315 may include a first elongated wall portion 325 and a second elongated wall portion 330 connected to each other. The first elongated wall portion 325 and the second elongated wall portion 330 may form a unified integrated structure of the elongated wall 315. The first and second elongated wall portions 325, 330 may have equivalent lengths and widths. Each of the first elongated wall portion 325 and the second elongated wall portion 330 may be slanted at a predefined angle "γ" relative to the elongated connector lateral axis. The angle "γ" may be in a range of 1 to 2 degrees. Since the first elongated wall portion 325 and the second elongated wall portion 330 are slanted relative to the elongated connector lateral axis, the first elongated wall portion 325 and the second elongated wall portion 330 may form an elongated ridge or peak 335 at an intersection point of the first elongated wall portion 325 and the second elongated wall portion 330. The elongated ridge 335 may be disposed at an elongated wall center portion and may have a length equivalent to an elongated wall length (or lengths of the first and second elongated wall portions 325, 330), as shown in FIG. 3.

In some aspects, one or more of the side walls 320 and the first and second elongated wall portions 325, 330 may be polished to have a smooth surface having RMS surface finish in a range of 15 to 40 RMS. In other aspects, one or more of the side walls 320 and the first and second elongated wall portions 325, 330 may have a textured surface.

In operation, the user may place the first building block 125 and the second building block 130 in proximity of each other, such that respective recesses 205 may be adjacent. The user may then insert the elongated connector 135 into adjacent recesses to enable connection or "interlocking" between the first building block 125 and the second building block 130. When the user inserts the elongated connector 135 into the adjacent recesses, the first portion 305 may insert into a first recess (e.g., a first building block recess) and the second portion 310 may insert into a second recess (e.g., a second building block recess) that may be adjacent to the first recess, thereby enabling secure connection between the first and second building blocks 125, 130. The "interlocking" arrangement of the elongated connector 135 and the first and second building blocks 125, 130 enables the user to conveniently and securely connect relatively large building blocks (e.g., may be as large as 4*4 inch cube), and stably build large structures. For example, the user may build a large-sized beam or arch by interlocking large building blocks using elongated connectors, which may not be possible using conventional small-sized building blocks that may not use elongated connectors for connection.

In some aspects, when the first portion 305 (or the second portion 310) may be inserted into the first recess (e.g., the recess 205), the elongated ridge 335 may touch the recess elongated wall 210, and remaining surfaces of the first and second elongated wall portions 325, 330 may not touch the recess elongated wall 210. Since the elongated ridge 335 touches the recess elongated wall 210 and a substantial elongated wall portion may not touch the recess elongated wall 210 when the elongated connector 135 is inserted into the recess 205, the user may experience less friction in inserting (or removing) the elongated connector 135 into the recess 205. Stated another way, elongated connector structure including the elongated ridge 335 assists the user in conveniently assembling and/or disassembling the first and second building blocks 125, 130, as friction between moving parts (e.g., the elongated wall 315 and the recess elongated wall 210) is substantially reduced due to elongated ridge presence.

In some aspects, the elongated connector 135 may be shaped (e.g., have dimensions) such that a predefined small space or gap may exist between opposing surfaces of adjacent building blocks when the adjacent building blocks may be connected with each other by using the elongated connector 135. The gap may enable the user to easily slide the adjacent building blocks against each other. In other aspects, no gap may exist between opposing surfaces of adjacent building blocks when the adjacent building blocks may be connected by using the elongated connector 135.

Although the description above describes an aspect where the elongated connector 135 is shaped as a double dovetail (or "bow-tie"), the present disclosure is not limited to such structure. In other aspects (not shown), the elongated connector 135 may be shaped as double ellipse, double diamond, figure eight, etc.

Further, although the description above describes an aspect where the interlocking building block system 105 includes a cube-shaped building block (e.g., the first and second building blocks 125, 130), in additional aspects, the interlocking building block system 105 may include blocks of different shapes. An exemplary building block of a different shape is shown in FIG. 4 and described below.

Figure 4:
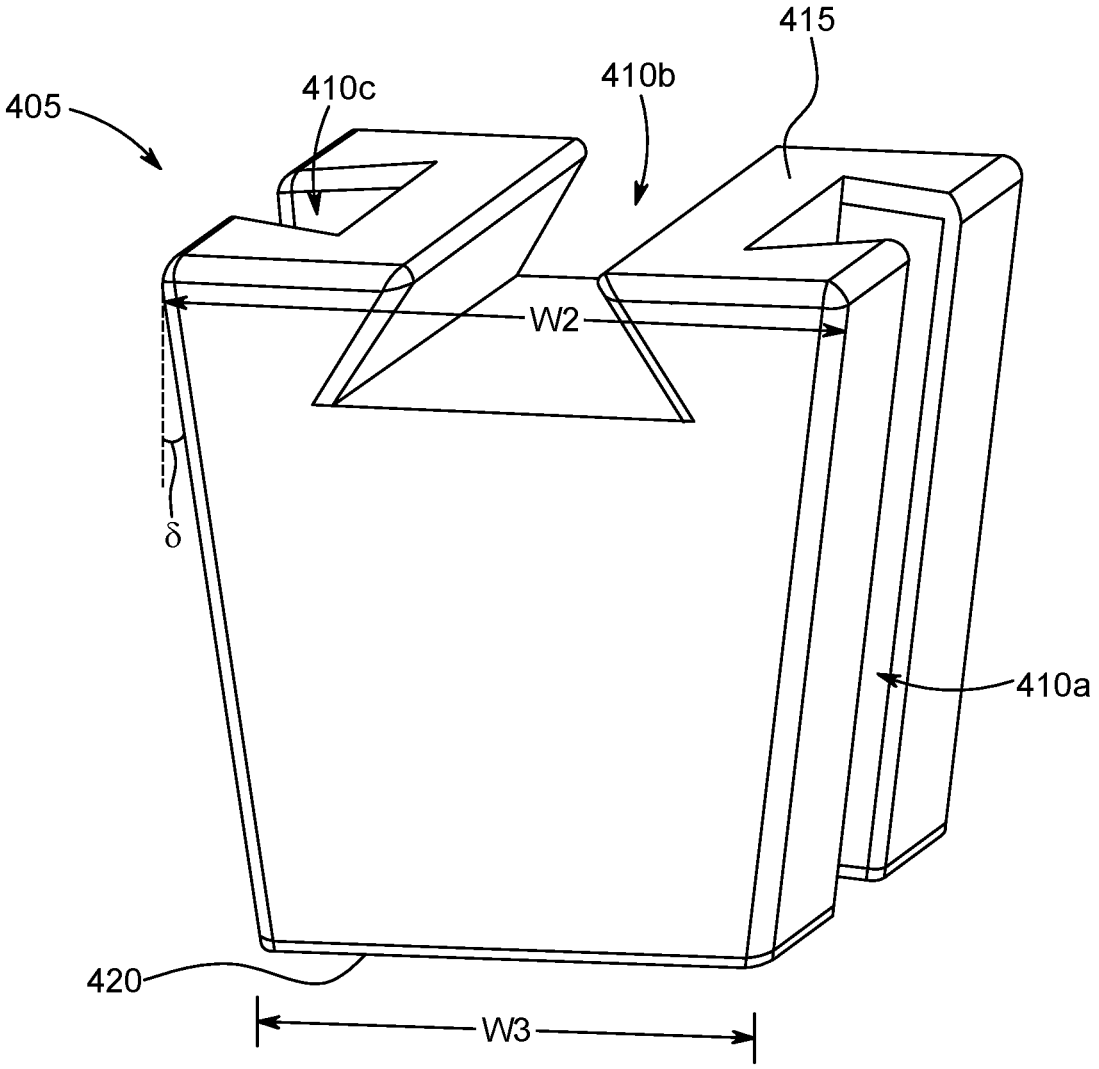
FIG. 4 depicts an isometric view of another example building block in accordance with the present disclosure.

FIG. 4 depicts an isometric view of an example building block 405 in accordance with the present disclosure. The building block 405 may be made of similar material as the first and second building blocks 125, 130, and may have recesses 410*a*, 410*b*, 410*c* that may be similar to the recesses 205. The building block 405 may have a triangular or truncated pyramid shape and may enable the user to form arches (e.g., the arch 115) using the building blocks 405, as shown in FIG. 1. Specifically, the user may dispose two building blocks 405 in proximity to each other and insert the elongated connector 135 into adjacent recesses to connect the building blocks 405, thereby forming an arch. The user may connect a plurality of building blocks 405 (using a plurality of elongated connectors) to form arches of different diameters. Building block connections by using elongated connectors enable the user to build stable and sturdy large-sized arches, which may not be possible using conventional small-sized building blocks that may not use elongated connectors for connection.

In some aspects, the building block 405 may include a top portion 415 having a width "W2" and a bottom portion 420 having a width "W3". The width "W2" may be greater than the width "W3". Specifically, side walls 425*a*, 425*b* of the building block 405 may be slanted by a predefined angle "δ" relative to a building block longitudinal axis, as shown in FIG. 4. The angle "δ" may be in a range of 10 to 20 degrees, which enables the user to form an arch when the user connects two or more building blocks 405 together by using the elongated connectors 135. In a preferred aspect, the angle "δ" may be 15 degrees.

Other building block 405 structural details are similar to building block 125, 130 structural details, and hence are not described again here for the sake of simplicity and conciseness.

Figure 5A:
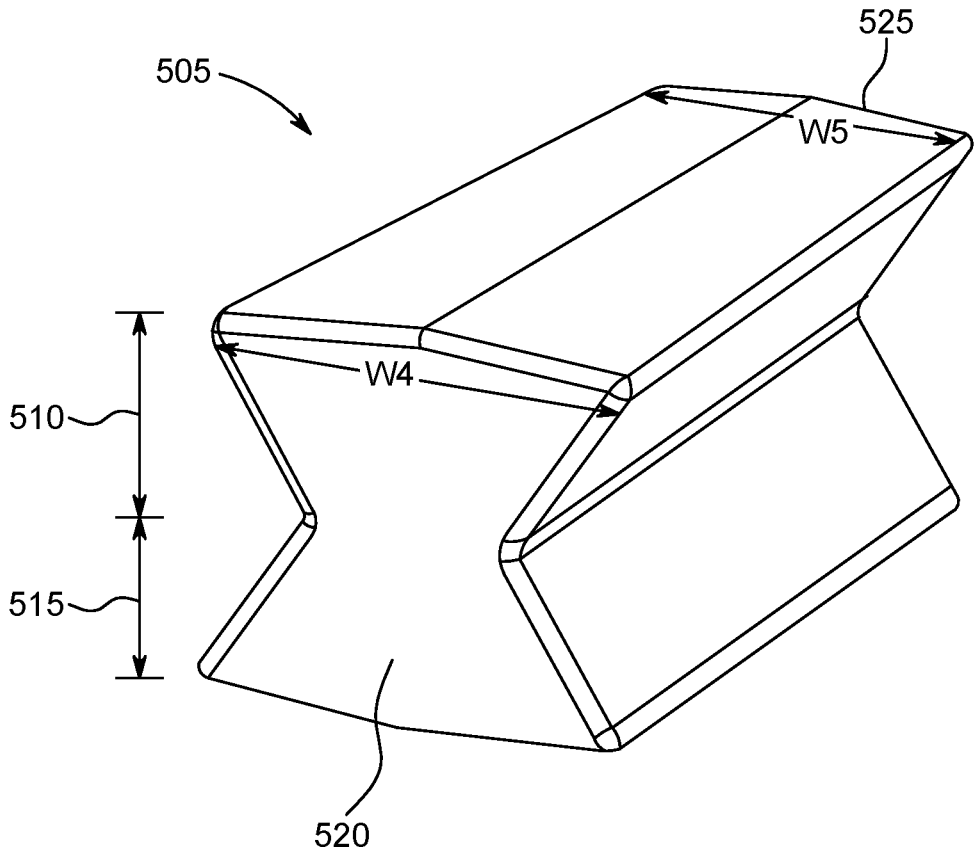
FIG. 5A depicts an isometric view of another example elongated connector in accordance with the present disclosure.

FIG. 5A depicts an isometric view of an elongated connector 505 in accordance with the present disclosure. The elongated connector 505 may be similar to the elongated connector 135; however, the elongated connector 505 may have a tapered width along an elongated connector length.

The elongated connector 505 may include a first portion 510 and a second portion 515 that may be similar to the first portion 305 and the second portion 310, respectively. Each of the first and second portions 510, 515 may include a proximal end 520 and a distal end 525. In an exemplary aspect, a proximal end width "W4" (e.g., width of a proximal end top/bottom surface) may be greater than a distal end width "W5" (e.g., width of a distal end top/bottom surface).

In some aspects, to connect the first and second building blocks 125, 130 by using the elongated connector 505, the user may insert the distal end 525 into the recesses 205 to enable connection between the first and second building blocks 125, 130. Elongated connector tapered-width structure ensures that the elongated connector 505 may only be inserted or removed to/from the recesses 205 via one end (e.g., the distal end 525), and hence probability of the elongated connector 505 "sliding out" from the recesses 205 is considerably reduced. Further, the elongated connector tapered-width structure may enable the user to build robust and sturdy connections (since the elongated connector 505 may not slide out from the recesses 205), which may be used for building engineering models.

In the exemplary aspect described here for FIG. 5A, respective building block recesses 205 may also have tapered width (not shown) similar to the elongated connector 505. Further, although FIG. 5A depicts the elongated connector 505 as having an elongated ridge at an elongated wall center portion, in some aspects (not shown), the elongated connector 505 may not include the elongated ridge. In this case, the elongated wall may be a flat surface.

Other elongated connector 505 structural details are similar to elongated connector 135 structural details, and hence are not described again here for the sake of simplicity and conciseness.

Figure 5B:
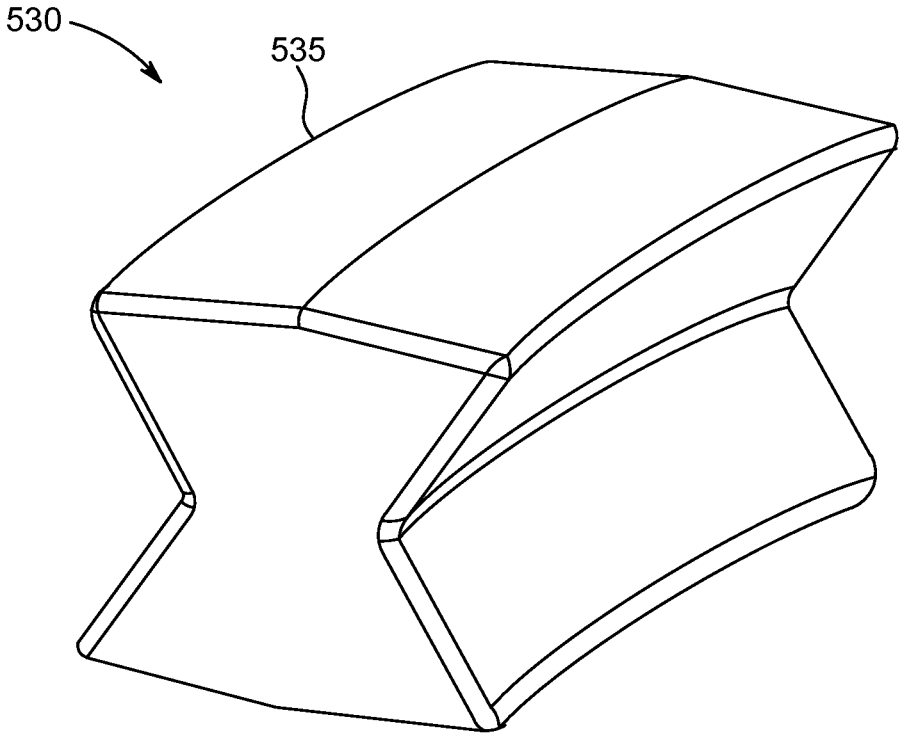
FIG. 5B depicts an isometric view of yet another example elongated connector in accordance with the present disclosure.

FIG. 5B depicts an isometric view of an elongated connector 530 in accordance with the present disclosure. The elongated connector 530 may be similar to the elongated connector 135; however, the elongated connector 530 may have a curved wall (e.g., shaped as a banana). Specifically, the elongated connector 530 may include an elongated wall 535 that may be shaped as an elongated arc along an elongated wall length, as shown in FIG. 5B. When the user inserts the elongated connector 530 into the recesses 205, the elongated arc "locks" against the side walls 215 to securely connect the first and second building blocks 125, 130. In this case as well, the elongated wall center portion may (as shown in FIG. 5B) or may not include the elongated ridge, as described above.

Other elongated connector 530 structural details are similar to elongated connector 135 structural details, and hence are not described again here for the sake of simplicity and conciseness.

Figure 5C:
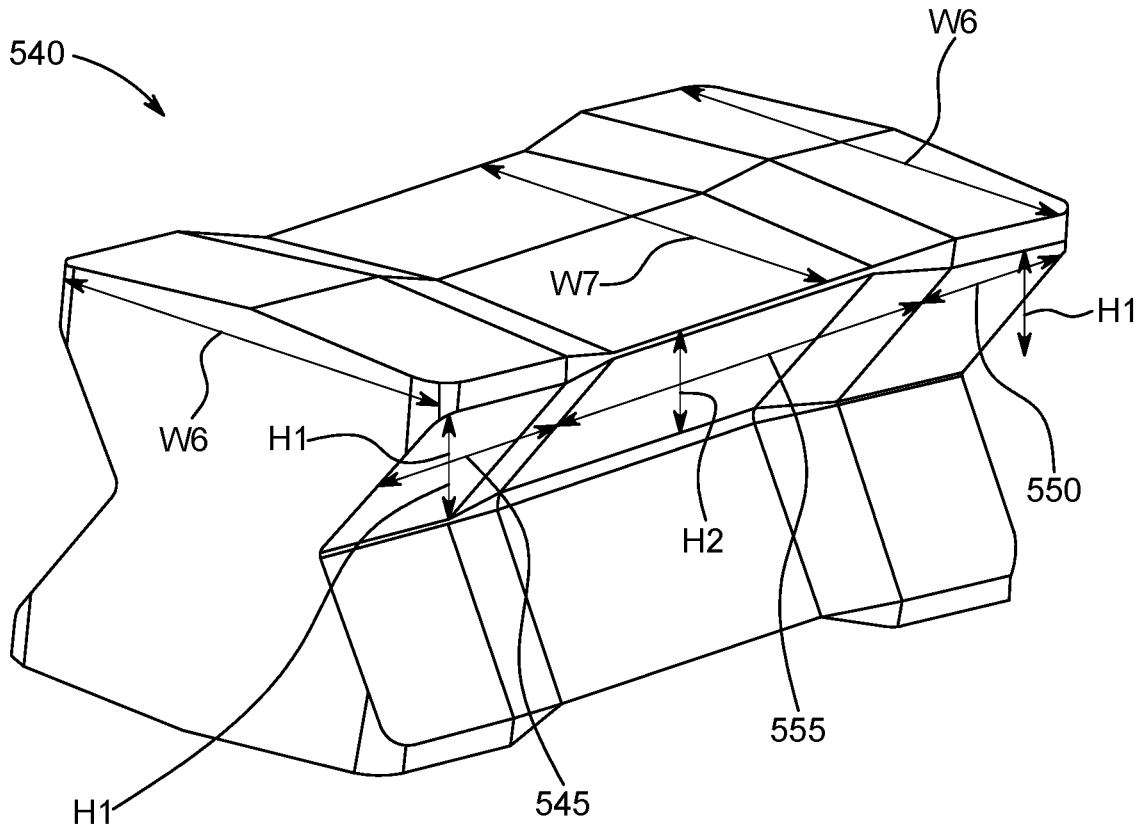
FIG. 5C depicts an isometric view of another example elongated connector in accordance with the present disclosure.

FIG. 5C depicts an isometric view of an elongated connector 540 in accordance with the present disclosure. The elongated connector 540 may be made of same material as the elongated connector 135; however, the elongated connector 540 may have a variable cross section or variable width along an elongated connector length. Specifically, the elongated connector 540 may include a proximal portion 545, a distal portion 550 and a middle portion 555 having variable widths. In an exemplary aspect, the widths of the proximal portion 545 and the distal portion 550 may be same, and equivalent to width "W6" as shown in FIG. 5C. In other aspects (not shown), the proximal portion 545 and the distal portion 550 may have different respective widths.

Width "W7" of the middle portion 555 may be less than the width "W6". Such variable cross section or width structure of the elongated connector 540 enables the user to build robust model structures. In this case, respective building block recesses 205 may have shapes complementary to the shape of the elongated connector 540 to enable stable connection. In further aspects, the proximal portion 545 and the distal portion 550 may have equivalent respective heights "H1", which may be greater than a height "H2" of the middle portion 555.

Although FIG. 5C depicts the elongated connector 540 as having an elongated ridge at an elongated wall center portion, in some aspects (not shown), the elongated connector 540 may not include the elongated ridge. In this case, the elongated wall may be a flat surface.

Figure 5D:
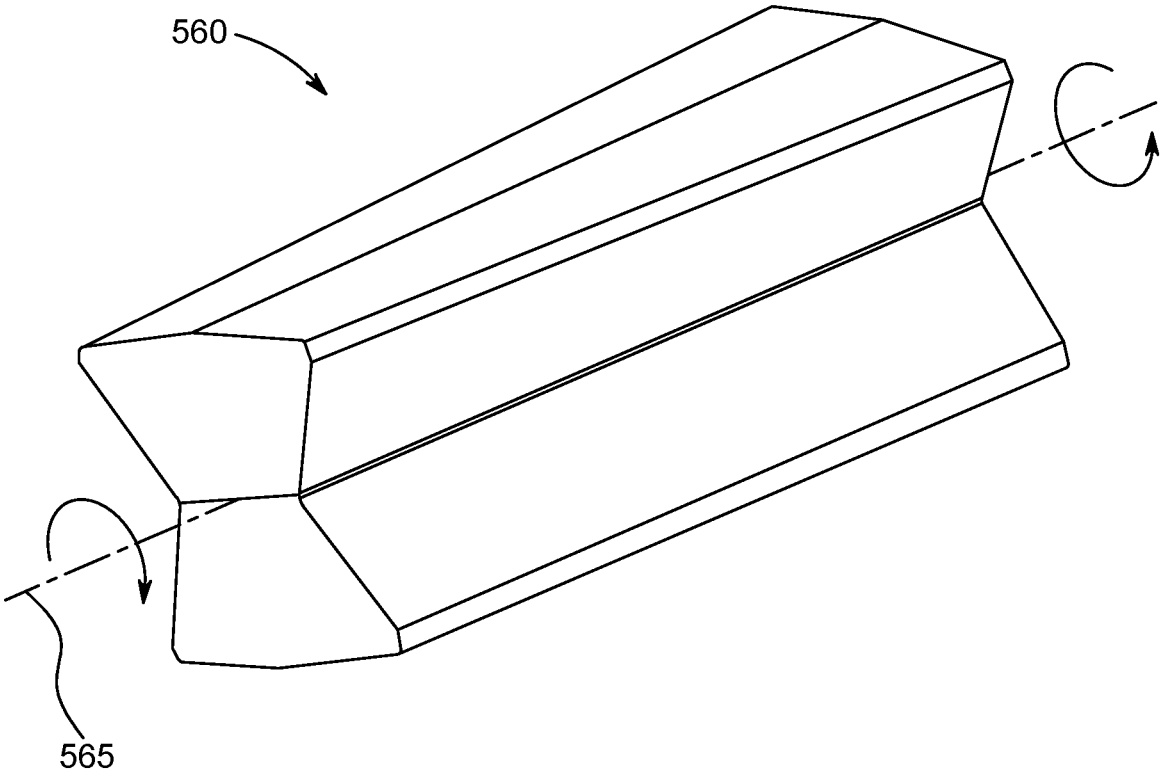
FIG. 5D depicts an isometric view of another example elongated connector in accordance with the present disclosure.

FIG. 5D depicts an isometric view of an elongated connector 560 in accordance with the present disclosure. The elongated connector 560 may be similar to the elongated connector 135; however, the elongated connector 560 may have a "twist" along an elongated connector longitudinal axis 565. In some aspects, the elongated connector 560 may have a rigid structure. In other aspects, the elongated connector 560 may have a flexible structure. Other details of the elongated connector 560 are same as the details of the elongated connector 135, and hence are not described again here for the sake of simplicity and conciseness.

In further aspects (not shown), the elongated connector 505, the elongated connector 530 and the elongated connector 560 too may have variable cross section or variable width along the elongated connector length (similar to the elongated connector 540). In additional aspects (not shown), the elongated connector 505, the elongated connector 530 and the elongated connector 540 too may have "twist" along respective elongated connector longitudinal axis.

Figure 6:
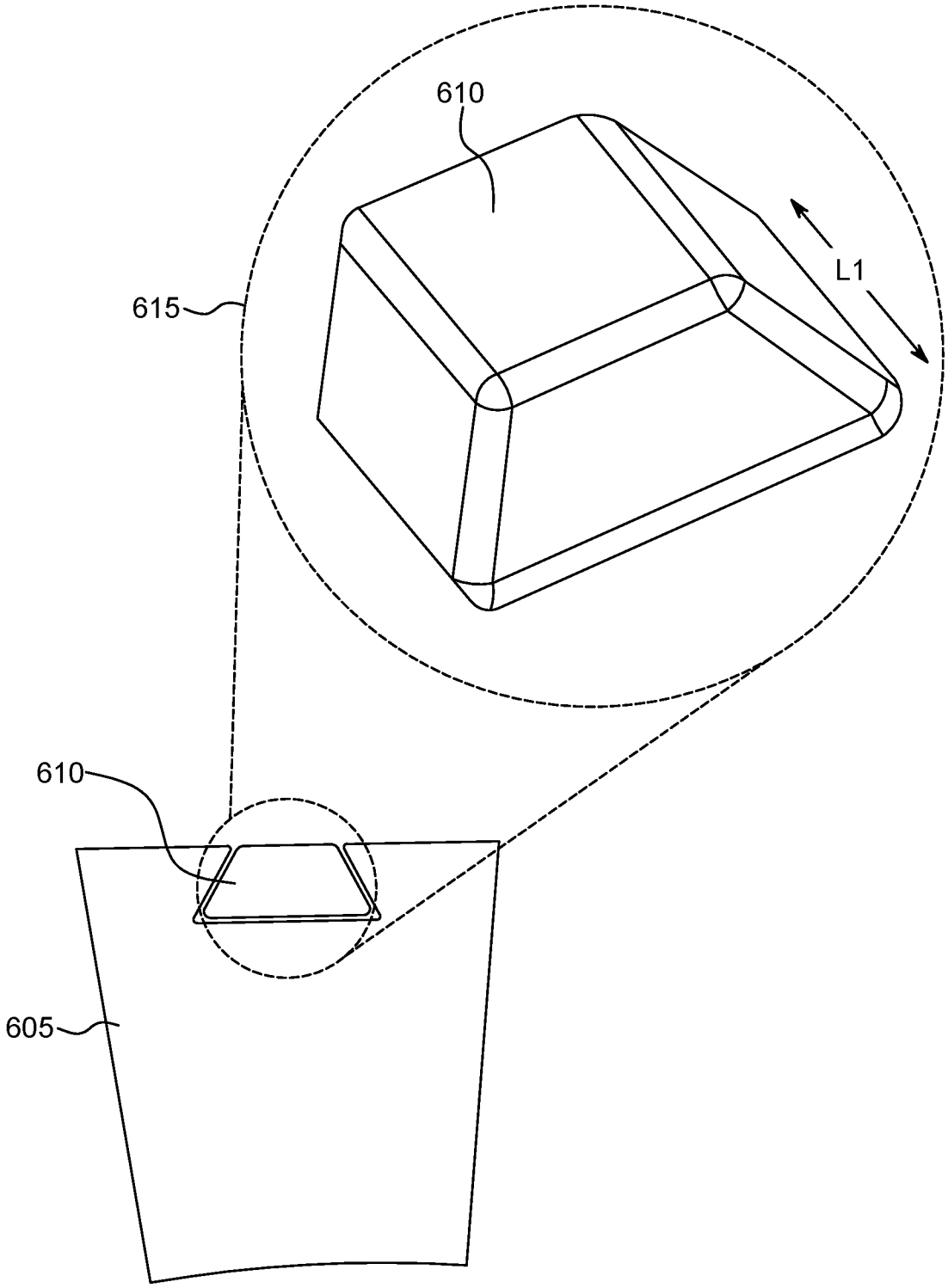
FIG. 6 depicts a side view of an example building block connected with a filler block in accordance with the present disclosure.

FIG. 6 depicts a side view of an example building block 605 connected with a filler block 610 in accordance with the present disclosure. The building block 605 may be same as the building blocks 125, 130, or 405. Stated another way, the building block 605 may be shaped as a cube, a cuboid or a truncated pyramid.

The filler block 610 may be a "half dovetail" connector. Specifically, the filler block 610 may have shape and dimensions similar to the shape and dimensions of the first portion 305, 510, or the second portion 310, 515. In some aspects, the user may insert the filler block 610 into a recess of the building block 605 to form a finished appearance of a built structure by filling-in exposed (or un-used) dovetail recesses (e.g., the recess of the building block 605). In other aspects (not shown), the filler block 610 may also be used to connect adjacent building blocks. For example, the user may insert half (or a portion) of a filler block length "L1" into a recess of a first building block, and may insert the other half (or remaining portion) of the filler block length "L1" into a recess of a second building block that may be disposed in proximity to the first building block, to connect the first and second building blocks.

In additional aspects, the interlocking building block system 105 may include other components (not shown) of different sizes and shapes (e.g., cubic blocks, triangular blocks, cylindrical blocks, etc.) to enable the user to build different types of model structures. Such additional blocks may also be connected with each other by using the elongated connectors described above.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An interlocking building block system comprising:

a first building block comprises a first recess on a first building block face;

a second building block comprises a second recess on a second building block face; and an elongated connector configured to connect the first building block and the second building block, wherein:

the elongated connector comprises a first portion and a second portion connected to each other, the first portion is configured to be inserted in the first recess, the second portion is configured to be inserted in the second recess, each of the first portion and the second portion comprises an elongated wall and side walls, and wherein the elongated wall comprises an elongated ridge at an elongated wall center portion disposed along an elongated wall length.

2. The interlocking building block system of claim 1, wherein the first building block and the second building block are shaped as a cube or a truncated pyramid.

3. The interlocking building block system of claim 1, wherein the first recess and the second recess are dovetail recesses.

4. The interlocking building block system of claim 1, wherein a first portion shape complements a first recess shape, and wherein a second portion shape complements a second recess shape.

5. The interlocking building block system of claim 1, wherein each of the first recess and the second recess comprises recess side walls.

6. The interlocking building block system of claim 5, wherein at least one of the side walls and the recess side walls is polished with a Root Mean Square (RMS) surface finish in a range of 15 to 40 RMS.

7. The interlocking building block system of claim 5, wherein at least one of the side walls and the recess side walls has a textured surface.

8. The interlocking building block system of claim 1, wherein the first portion and the second portion form a unified integrated structure of the elongated connector.

9. The interlocking building block system of claim 1, wherein the first portion and the second portion have mirrored shapes.

10. The interlocking building block system of claim 1, wherein the side walls are slanted at a predefined angle relative to an elongated wall lateral axis.

11. The interlocking building block system of claim 1, wherein each of the first portion and the second portion comprises a proximal end and a distal end, and wherein a proximal end width is greater than a distal end width.

12. The interlocking building block system of claim 11, wherein the first portion and the second portion are configured to be inserted into the first recess and the second recess via respective distal ends.

13. The interlocking building block system of claim 1, wherein the elongated wall is shaped as an elongated arc.

14. An interlocking building block system comprising:

a first building block comprises a first recess on a first building block face;

a second building block comprises a second recess on a second building block face; and an elongated connector configured to connect the first building block and the second building block, wherein:

the elongated connector comprises a first portion and a second portion connected to each other, the first portion is configured to be inserted in the first recess, the second portion is configured to be inserted in the second recess, each of the first portion and the second portion comprises a proximal end and a distal end, a proximal end width is greater than a distal end width, the first portion and the second portion are configured to be inserted into the first recess and the second recess via respective distal ends, each of the first portion and the second portion comprises an elongated wall and side walls, and the elongated wall comprises an elongated ridge at an elongated wall center portion disposed along an elongated wall length.

15. The interlocking building block system of claim 14, wherein the first recess and the second recess are dovetail recesses.

16. The interlocking building block system of claim 14, wherein a first portion shape complements a first recess shape, and wherein a second portion shape complements a second recess shape.

17. The interlocking building block system of claim 14, wherein the first portion and the second portion form a unified integrated structure of the elongated connector.

18. The interlocking building block system of claim 14, wherein the first portion and the second portion have mirrored shapes.

19. The interlocking building block system of claim 14, wherein the first building block and the second building block are shaped as a cube or a truncated pyramid.

20. An interlocking building block system comprising:

a first building block comprises a first recess on a first building block face;

a second building block comprises a second recess on a second building block face; and an elongated connector configured to connect the first building block and the second building block, wherein:

the elongated connector comprises a first portion and a second portion connected to each other, the first portion is configured to be inserted in the first recess, the second portion is configured to be inserted in the second recess, each of the first portion and the second portion comprises an elongated wall and side walls, and wherein the elongated wall is shaped as an elongated arc.

* * * * *